US011569080B2

(12) United States Patent
Miura et al.

(10) Patent No.: US 11,569,080 B2
(45) Date of Patent: Jan. 31, 2023

(54) METHOD FOR MASS SPECTROMETRY AND MASS SPECTROMETER

(71) Applicant: SHIMADZU CORPORATION, Kyoto (JP)

(72) Inventors: Hiroyuki Miura, Kyoto (JP); Hideaki Izumi, Kyoto (JP)

(73) Assignee: SHIMADZU CORPORATION, Kyoto (JP)

( * ) Notice: Subject to any disclaimer, the term of this patent is extended or adjusted under 35 U.S.C. 154(b) by 0 days.

(21) Appl. No.: 17/329,341

(22) Filed: May 25, 2021

(65) Prior Publication Data

US 2022/0059329 A1 Feb. 24, 2022

(30) Foreign Application Priority Data

Aug. 19, 2020 (JP) ..... JP2020-138891

(51) Int. Cl.

| | |
|---|---|
| ***H01J 49/00*** | (2006.01) |
| ***H01J 49/24*** | (2006.01) |
| ***H01J 49/40*** | (2006.01) |
| ***H01J 49/04*** | (2006.01) |

(52) U.S. Cl.

CPC ..... *H01J 49/0031* (2013.01); *H01J 49/005* (2013.01); *H01J 49/0468* (2013.01); *H01J 49/24* (2013.01); *H01J 49/40* (2013.01)

(58) Field of Classification Search

CPC .... H01J 49/0031; H01J 49/0468; H01J 49/24; H01J 49/40; H01J 49/408; H01J 49/0481; H01J 49/005

USPC ..... 250/281, 282

See application file for complete search history.

(56) References Cited

U.S. PATENT DOCUMENTS

| | | | | |
|---|---|---|---|---|
| 6,570,152 | B1 | 5/2003 | Hoyes | |
| 9,281,175 | B2 | 3/2016 | Haufler et al. | |
| 10,600,631 | B2 | 3/2020 | Giles et al. | |
| 2009/0278042 | A1 | 11/2009 | Izumi et al. | |
| 2011/0163227 | A1* | 7/2011 | Makarov | G01N 27/622 250/281 |
| 2011/0215239 | A1 | 9/2011 | Yamaguchi | |
| 2014/0224973 | A1* | 8/2014 | Sekiya | G01N 33/68 250/281 |
| 2020/0035478 | A1* | 1/2020 | Takahashi | H01J 49/0054 |

FOREIGN PATENT DOCUMENTS

| | | | |
|---|---|---|---|
| WO | 2008/072377 | A1 | 6/2008 |
| WO | 2010/049972 | A1 | 5/2010 |
| WO | 2013/057505 | A2 | 4/2013 |

* cited by examiner

*Primary Examiner* — Kiet T Nguyen

(74) *Attorney, Agent, or Firm* — Sughrue Mion, PLLC

(57) ABSTRACT

Provided is a method for mass spectrometry in which ions to be analyzed are made to come in contact with a cooling gas in a cooling section, such as an ion trap 2, configured to perform the cooling of ions, and kinetic energy is subsequently imparted to the ions so as to introduce the ions into a flight space of a multi-turn time-of-flight mass separator 30 or similar device for separating ions according to their mass-to-charge ratios. According to the present invention, when a known or estimated number of charges of an ion to be analyzed is high, the amount of supply of the cooling gas to the cooling section is set to a lower level than when the number of charges is low. This operation improves the detection sensitivity for ions having large molecular weights and high numbers of charges.

5 Claims, 6 Drawing Sheets

METHOD FOR MASS SPECTROMETRY AND MASS SPECTROMETER

TECHNICAL FIELD

The present invention relates to a method for mass spectrometry and a mass spectrometer. More specifically, it relates to a method for mass spectrometry and a mass spectrometer using a time-of-flight mass separator.

BACKGROUND ART

An ion trap time-of-flight mass spectrometer includes an ion trap and a time-of-flight mass separator, as disclosed in Patent Literature 1 or other related documents. In the ion trap time-of-flight mass spectrometer, various ions generated from a sample are temporarily captured within the ion trap. Subsequently, those various ions are simultaneously accelerated and ejected from the ion trap, to be introduced into the time-of-flight mass separator. The accelerated ions fly at different speeds according to their respective mass-to-charge ratios (strictly speaking, this should be referred to as m/z, although the term "mass-to-charge ratio" is used throughout the present description according to a common practice). Therefore, while travelling in the flight space in the time-of-flight mass separator, the ions are separated from each other according to their mass-to-charge ratios, to ultimately arrive at and be detected by a detector.

In a time-of-flight mass spectrometer (which may be hereinafter called the "TOFMS" according to a common practice), the longer the flight distance of the ions is, the higher the mass-resolving power becomes. Accordingly, in general, a reflectron TOFMS, which makes ions fly in a round-trip path, as disclosed in Patent Literature 1, can more easily achieve a higher level of mass-resolving power than a linear TOFMS, which makes ions fly in a straight path.

Patent Literature 2 or 3 discloses a TOFMS employing a reflectron configured to reflect ions two or more times, thereby enabling a further elongation of the flight length. This type of reflectron configured to elongate the flight length of ions by two or more reflections is called a "multi-reflectron TOFMS".

Patent Literature 4 discloses a TOFMS which enables a further elongation of the flight length of the ions by making the ions turn a number of times along substantially identical orbital paths. Patent Literature 5 discloses a TOFMS in which the orbital path for one turn has a substantially circular shape, substantially elliptical shape, substantially letter-"8" shape or other appropriate shapes, in which the path is gradually shifted for every turn of the ions in the path so as to increase the number of turns while preventing the ions from flying along the same path, thereby allowing for a further elongation of the flight length. This type of TOFMS configured to elongate the flight length of the ions by making the ions fly in a loop orbit multiple times is called a "multi-turn TOFMS". In particular, the multi-turn TOFMS allows for a dramatic elongation of the flight length without significantly increasing the entire size of the device, so that it can be small in size yet can achieve a high level of mass-resolving power.

As for the ion trap, Patent Literature 1 discloses a three-dimensional quadrupole ion trap which includes one ring-shaped electrode and a pair of end caps. Another commonly known type of ion trap is a linear ion trap which includes four rod electrodes arranged parallel to and around a central axis as well as a pair of end-cap electrodes arranged so that the rod electrodes are sandwiched in between.

For example, in the configuration of an ion trap disclosed in Patent Literature 6, a cooling gas is introduced into a linear ion trap formed by a plurality of electrode segments consecutively positioned along an axis, so as to efficiently capture ions within the ion trap as well as sufficiently lower the energy of the ions by the cooling process before ejecting the ions toward the time-of-flight mass separator.

CITATION LIST

Patent Literature

Patent Literature 1: WO 2008/072377 A
Patent Literature 2: U.S. Pat. No. 9,281,175 B
Patent Literature 3: U.S. Pat. No. 6,570,152 B
Patent Literature 4: WO 2010/049972 A
Patent Literature 5: WO 2013/057505 A
Patent Literature 6: U.S. Pat. No. 10,600,631 B

SUMMARY OF INVENTION

Technical Problem

As noted earlier, in a mass spectrometer employing a time-of-flight mass separator, increasing the flight distance of the ions improves the mass-resolving power. However, a problem exists in that increasing the flight distance also increases the loss of the ions in the middle of their flight, which decreases the number of ions reaching the detector and lowers detection sensitivity. One possible cause of the loss of the ions in the middle of their flight is the dissipation of the ions due to the collision with the gas which remains in the flight path. In order to maximally prevent this dissipation, the inner space of the chamber which contains the time-of-flight mass separator is normally maintained at a high degree of vacuum.

In recent years, mass spectrometry has been frequently used for the detection of a trace amount of compound contained in a biological sample or similar type of sample, and an improvement in its detection sensitivity has been strongly desired. An even higher level of detection sensitivity is required in the case of an $MS^n$ analysis in which an ion derived from a sample is fragmented by collision induced dissociation or similar techniques before being analyzed, since the amount of target ion in this type of mass spectrometric analysis is often dramatically smaller than that of the original compound. With such a technical background, it has been even more important for a TOFMS to reduce the loss of the ions to be subjected to the analysis and thereby improve the detection sensitivity.

The present invention has been developed to solve this problem. Its objective is to provide a method for mass spectrometry and a mass spectrometer that can improve the detection sensitivity for ions by reducing the loss of the ions in a path in which the ions accelerated by an ion-accelerating section fly until they arrive at a detector.

Solution to Problem

One mode of the method for mass spectrometry according to the present invention developed for solving the previously described problem is a method for mass spectrometry in which ions to be analyzed are made to come in contact with a cooling gas in a cooling section configured to perform the cooling of ions, and kinetic energy is subsequently imparted to the ions so as to introduce the ions into a flight space for separating ions according to the mass-to-charge ratios of the ions, where the method is configured so that, when a known or estimated number of charges of an ion to be analyzed is high, the amount of supply of the cooling gas to the cooling section is set to a lower level than when the number of charges is low.

One mode of the mass spectrometer according to the present invention developed for solving the previously described problem includes:

a cooling section configured to perform the cooling of ions to be analyzed, by making the ions come in contact with a cooling gas;

an ion-accelerating section configured to impart kinetic energy to the ions after the cooling;

a time-of-flight mass-separating section including a flight space for separating ions according to the mass-to-charge ratios of the ions, the flight space configured so that the ions having the kinetic energy imparted in the ion-accelerating section are introduced into the flight space;

a detecting section configured to detect the ions separated by the time-of-flight mass-separating section; and a gas-supply regulating section configured to regulate the amount of supply of the cooling gas to the cooling section so that the amount of supply is changed according to a known or estimated number of charges of an ion to be analyzed.

An ion trap time-of-flight mass spectrometer normally performs a cooling process using a cooling gas (which is typically an inert gas, such as argon, helium or nitrogen) when temporarily capturing ions within an ion trap in the previously described manner. An orthogonal acceleration type of time-of-flight mass spectrometer, which does not use an ion trap, may also perform a cooling process to decrease the speed of the ions entering an orthogonal accelerator or facilitate the operation of converging the ions into an area near the axis. For example, in an ion trap time-of-flight mass spectrometer, the cooling operation lowers the amount of kinetic energy of the ions, making it more likely for the ions to come closer to the center of the ion trap. This reduces the amounts of variation in position, speed, ejecting direction and other aspects of the ions when the ions are ejected by acceleration. Consequently, the mass accuracy and mass-resolving power are improved.

However, a portion of the cooling gas supplied to the cooling section, such as an ion trap, flows into an ion introduction path through which the ejected ions enter the flight space, and further into the flight space, forming a residual gas which may possibly collide with and cause the loss of the ions. The chance of the collision of an ion with the residual gas should increase with an increase in the collision cross section of the ion. Accordingly, the present inventors have conducted various studies on the collision cross section of ions and has discovered that there is a high correlation between the number of charges and collision cross section of ions, and particularly in the case of high-molecular compounds. According to this finding, it is possible to infer that an ion having a higher number of charges has a larger collision cross section than an ion having a lower number of charges, and is therefore more likely to collide with the residual gas, which results in an increase in the loss of the ions.

Accordingly, in one mode of the method for mass spectrometry and mass spectrometer according to the present invention, if the number of charges of an ion to be analyzed has been previously known or estimated, the amount of supply of the cooling gas is changed according to that number of charges. Specifically, when the number of charges of the ion to be analyzed is high or is estimated to be high, the amount of supply of the cooling gas is set to a lower level than when the number of charges of the ion to be analyzed is low. The amount of gas flowing from the cooling section into the ion introduction path and the flight space is thereby directly reduced, whereby the amount of residual gas in the aforementioned path and space can be decreased. Consequently, ions which have high numbers of charges and accordingly large collision cross sections will also be less likely to collide with the residual gas, so that the loss of the ions due to collision will be decreased.

Advantageous Effects of Invention

According to one mode of the method for mass spectrometry and mass spectrometer according to the present invention, it is possible to reduce the loss of an ion which has such a large molecular weight and high number of charges that give the ion a particularly large collision cross section which makes the ion easy to collide with a residual gas and be lost. Consequently, the detection sensitivity for ions having large molecular weights and high numbers of charges will be improved.

DESCRIPTION OF EMBODIMENTS

[Principle of Method for Mass Spectrometry According to Present Invention]

Hereinafter described is a factor that causes the problem to be solved by the present invention, as well as the principle of a method for analyzing the cause.

Figure 4A:
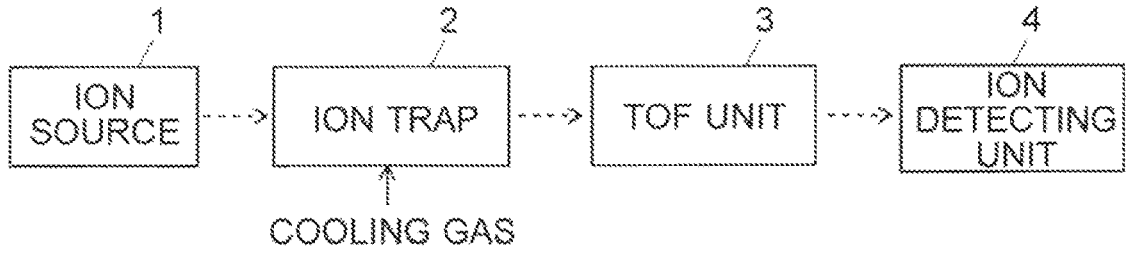
FIGS. 4A and 4B are basic block configuration diagrams of the mass spectrometer according to the present invention.
Figure 4B:
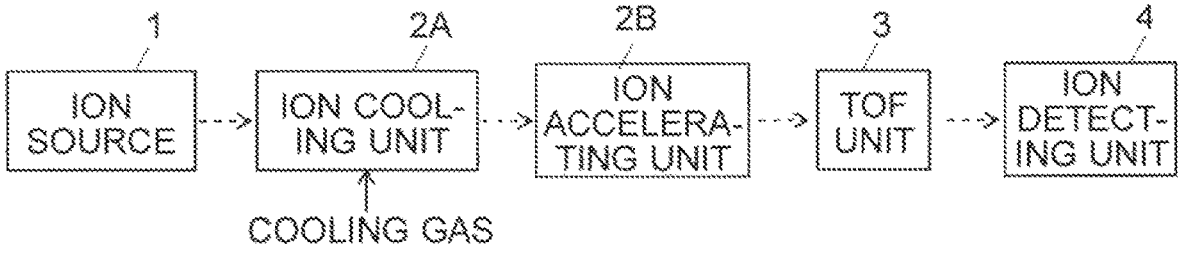

FIGS. 4A and 4B are extremely schematic configuration diagrams of commonly used mass spectrometers. FIG. 4A is a device having an ion trap, such as an ion trap TOFMS, while FIG. 4B is a device with no ion trap, such as an orthogonal acceleration TOFMS.

In FIG. 4A, an ion source 1 ionizes compounds contained in a sample. The various ions thereby produced are introduced into and temporarily captured within an ion trap 2 formed by a plurality of electrodes. Meanwhile, a cooling gas, such as helium, is supplied into the ion trap 2 so as to make the ions collide with the gas and thereby lower the kinetic energy of the ions. That is, the cooling operation for the ions is performed. Subsequently, predetermined voltages are applied to the electrodes forming the ion trap 2, whereby an amount of kinetic energy is simultaneously imparted to the captured ions. The ions are thereby ejected from the ion trap 2 into a time-of-flight mass separator (TOF unit) 3. While flying in the flight space in the TOF unit 3, the ions are separated from each other according to their mass-to-charge ratios. An ion-detecting unit 4 sequentially detects the separated ions and produces a detection signal whose intensity corresponds to the amount of ions. The time of flight of an ion in the flight space in the TOF unit 3 depends on the mass-to-charge ratio of the ion. Accordingly, a mass spectrum which shows the relationship between the mass-to-charge ratio and signal intensity can be obtained from a time-of-flight spectrum which shows the relationship between the time and signal intensity obtained with the ion-detecting unit 4.

In the device shown in FIG. 4A, both the cooling and ion-accelerating operations are performed in the ion trap 2. On the other hand, in the device shown in FIG. 4B, the ion-cooling unit 2A and ion-accelerating unit 2B are separated from each other. Ions introduced into the ion-cooling unit 2A lose their kinetic energy due to the contact with the cooling gas during their movement, forming to a certain extent a cloud before being introduced into the ion-accelerating unit 2B. The ion-accelerating unit 2B simultaneously accelerates the introduced ions and sends them into the TOF unit 3 in a packet-like form.

In any of the configurations of FIGS. 4A and 4B, the TOF unit 3 is normally contained in a chamber maintained at a particularly high degree of vacuum. However, since its separation from the ion trap 2 or ion-cooling unit 2A in the previous stage is not perfect, a portion of the cooling gas flows into the flight space in the TOF unit 3. Even if there is no cooling gas reaching the flight space, a portion of the cooling gas is present in the ion introduction path from the position of the acceleration of the ions in the ion trap 2 or ion-accelerating unit 2B to the position of the entry of the ions into the flight space. If ions come in contact with such types of residual gas originating from the cooling gas, the ions will be dissipated and lost. A possible solution is to directly decrease the amount of supply of the cooling gas in order to reduce the amount of residual gas. However, this will lower the cooling effect and may weaken the effect of improving the mass accuracy and mass-resolving power by the cooling operation.

Considering those problems, the present inventors have focused on the collision cross section of ions. This viewpoint is significant because both the ion-cooling effect and the loss of ions due to their contact with a residual gas result from the contact of the ions with the gas, and the probability of this contact should depend on the collision cross section of the ions.

Figure 5:
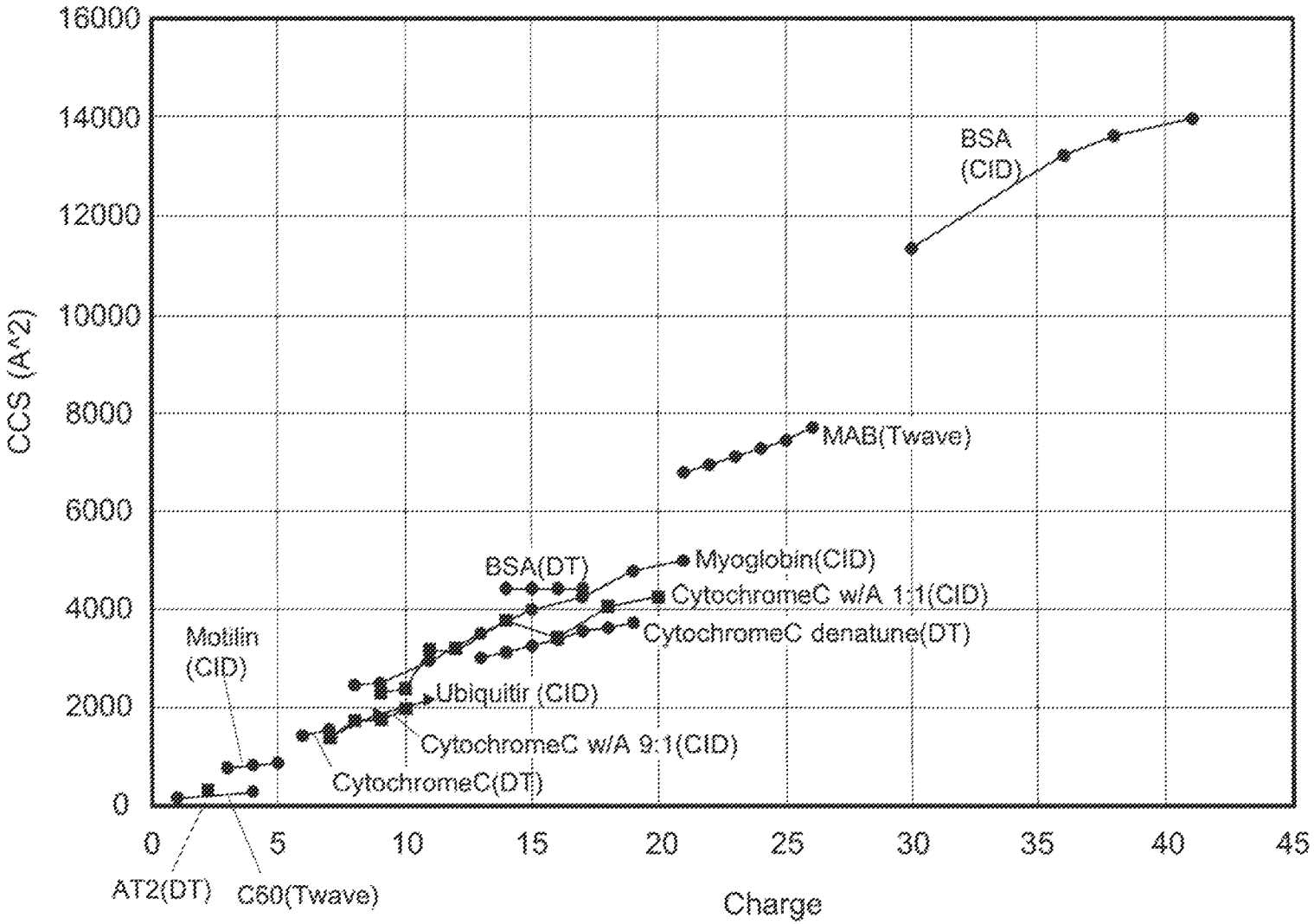
FIG. 5 is a graph showing a relationship between the number of charges and collision cross section of ions.

The present inventors have derived a relationship between the number of charges and collision cross section of ions for various high-molecular compounds based on various literature values. FIG. 5 is a graph summarizing the result. In FIG. 5, BSA stands for bovine serum albumin, MAB stands for monoclonal antibody, and AT2 stands for angiotensin II. "CID" in parenthesis means "collision-induced dissociation". "DT" means "drift tube", and Twave means "travelling wave", which respectively indicate the values in a CID process, values during a flight in a uniform electric field, and values during a travel in a travelling-wave tube.

In FIG. 5, a compound at a righter position has a larger molecular weight. The larger the molecular weight, the higher the number of charges. Even the same compound tends to have a larger collision cross section when it has a higher number of charges. A possible reason for this tendency is that the higher number of charges causes the ion to be expanded by its own electrostatic repulsion, which increases the entire size of the ion.

As compared to an ion having a small collision cross section, an ion having a large collision cross section has a higher probability of coming in contact with the cooling gas, and therefore, can be cooled more effectively. However, a larger collision cross section also means that the ion is more likely to come in contact with the residual gas and be dissipated halfway in its flight, causing a decrease in sensitivity. In conventional mass spectrometers, the decrease in detection sensitivity due to the cooling gas is not considered, and naturally, no measure has been taken to deal with the problem. By comparison, the method for mass spectrometry and the mass spectrometer according to the present invention deal with the problem by making use of the fact that there is a correlation between the number of charges and collision cross section of ions: For an analysis of an ion having a high number of charges, the amount of supply of the cooling gas is set to a lower level than for an ion having a low number of charges, so as to reduce the amount of cooling gas flowing into the ion introduction path or flight space. This lowers the frequency of the collision between the ion and the residual gas originating from the cooling gas which can occur during the period of time from the point of the ejection of the ion from the ion trap 2 or ion-accelerating unit 2B to the point of its entry into the flight space, as well as during the flight of the ion in the TOF unit 3. Consequently, the loss of the ion is reduced.

On the other hand, due to the large collision cross section of the ion, the chance of the ion's coming in contact with the cooling gas within the ion trap 2 or ion-cooling unit 2A will not significantly decrease even when the amount of supply of the cooling gas is reduced, so that a sufficient level of cooling effect can be obtained. Needless to say, when it is important to maintain the required level of cooling effect more assuredly with the lowered amount of supply of the cooling gas, the cooling time may be set longer than in the case of supplying a large amount of cooling gas.

In order to change the amount of supply of the cooling gas according to the number of charges of the ion in the previously described manner, the number of charges of the ion to be analyzed needs to be previously known or estimated. Although there may be two or more kinds of ions to be analyzed, the numbers of charges of those ions must be close to each other (i.e., the mixture of ions with high numbers of charges and those with low numbers of charges must be avoided) regardless of whether those ions originate from the same compound or different kinds of compounds. Due to those requirements, the technique according to the present invention is unsuitable for an analysis of a completely unknown compound. When the compound contained in the sample is unknown, or when the kind of compound is known but its number of charges cannot be estimated, it is preferable to previously perform a preliminary mass spectrometric analysis for determining or estimating the number of charges of the ion to be analyzed.

Another possible strategy to deal with an unknown number of charges of the ion to be analyzed is to perform analyses for the same ion species multiple times with different amounts of supply of the cooling gas, such as one analysis performed with a relatively small amount of supply of the cooling gas on the assumption that the number of charges is high, followed by another analysis performed with a relatively large amount of supply of the cooling gas on the assumption that the number of charges is low, and to compare the results of those analyses.

[Configuration and Operation of MT-TOFMS as One Embodiment]

One embodiment of the mass spectrometer according to the present invention is hereinafter described with reference to the attached drawings.

Figure 1:
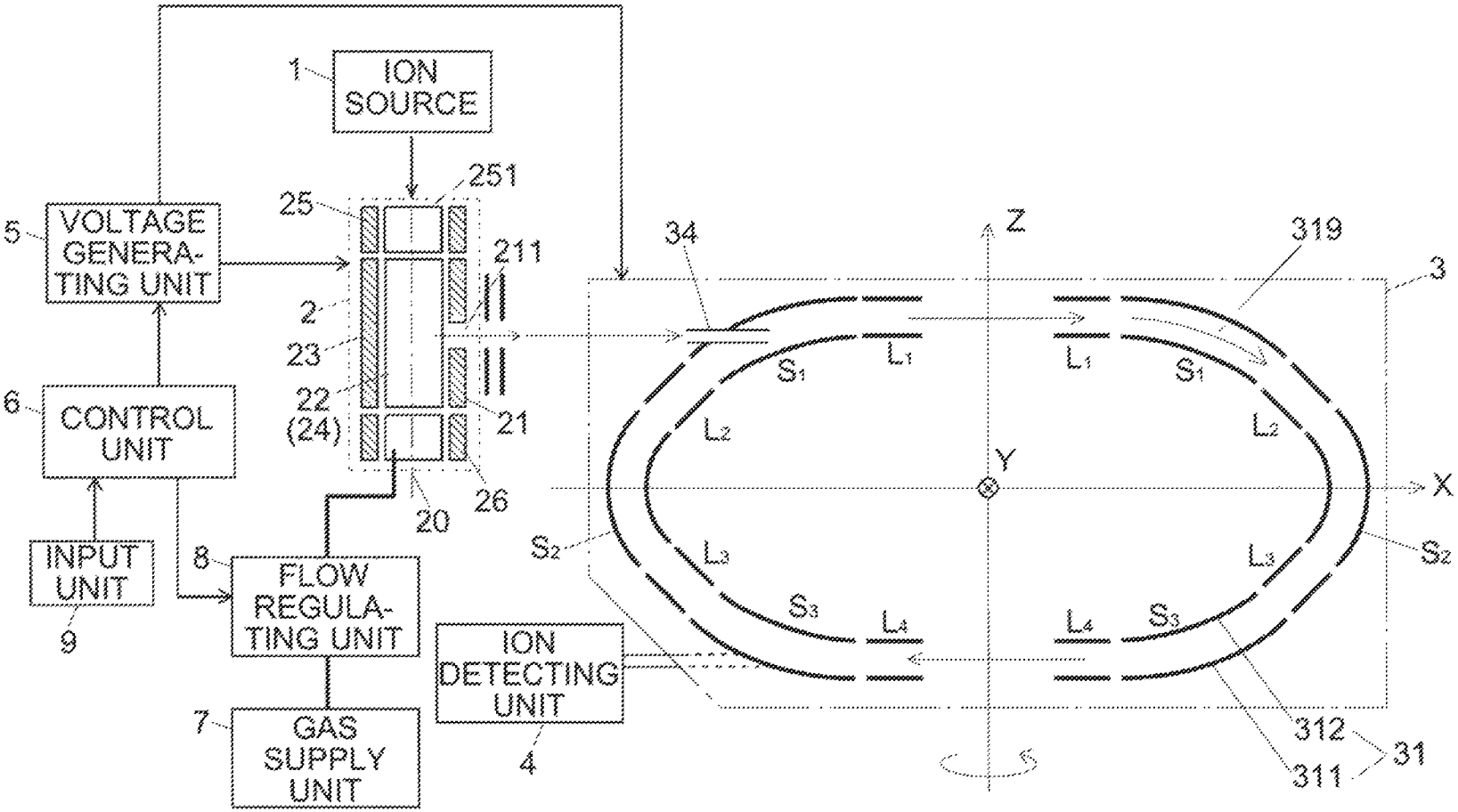
FIG. 1 is a schematic block configuration diagram of an MT-TOFMS as one embodiment of the mass spectrometer according to the present invention.
Figure 2A:
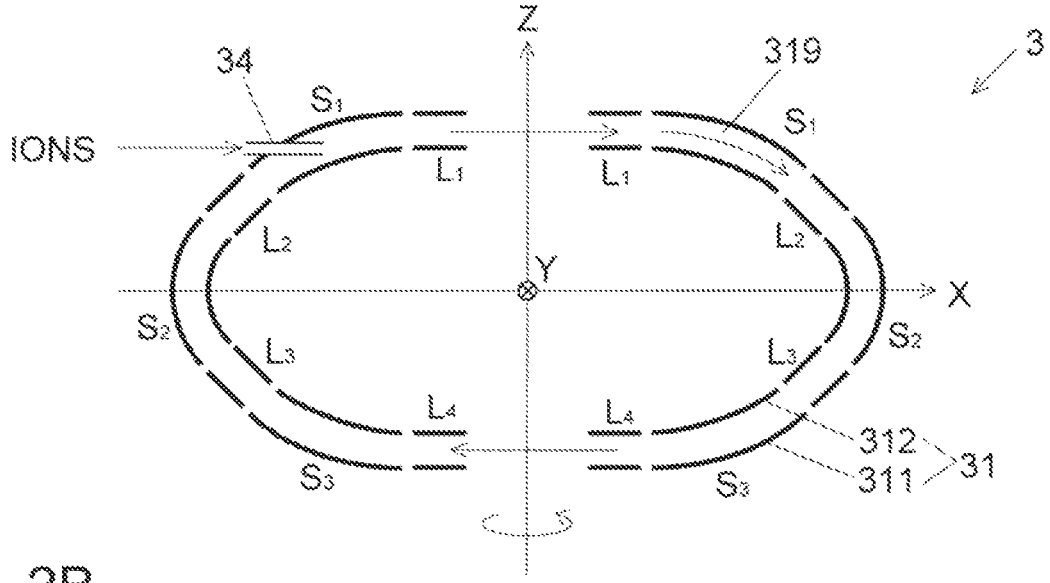
FIGS. 2A and 2B are a vertical sectional view and top view, respectively, of a multi-turn mass-separating section in the MT-TOFMS according to the present embodiment.
Figure 2B:
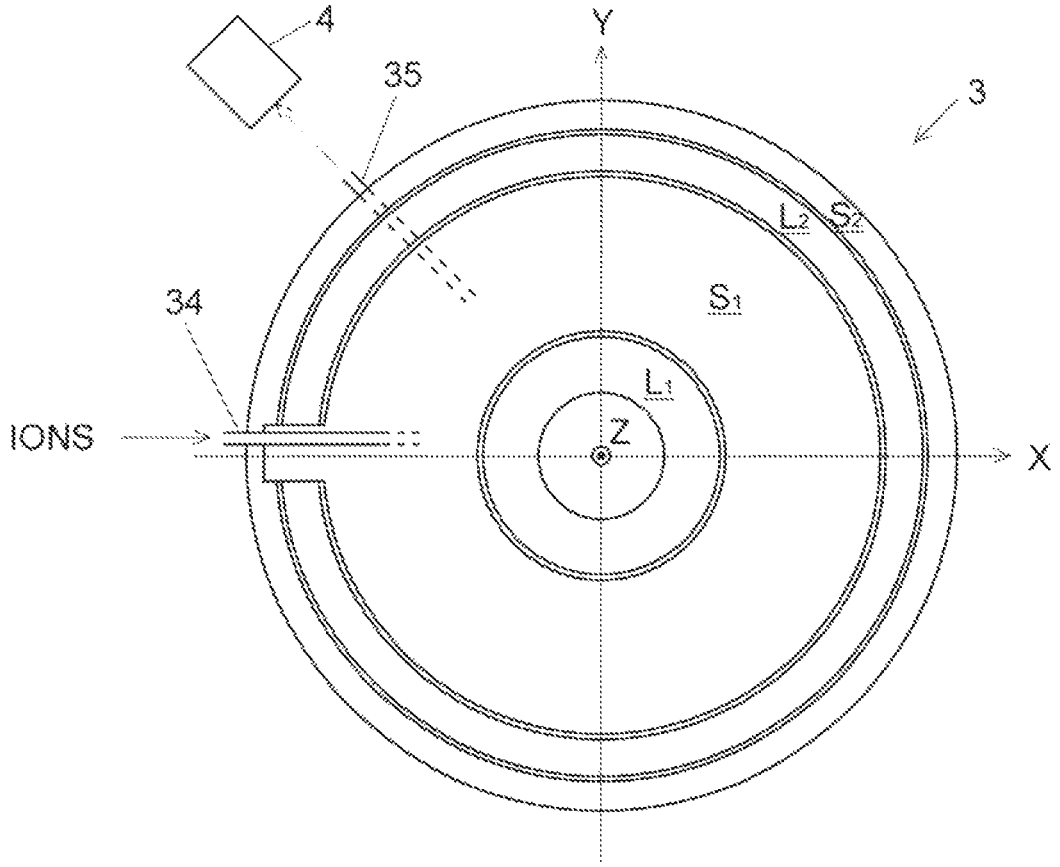
Figure 3:
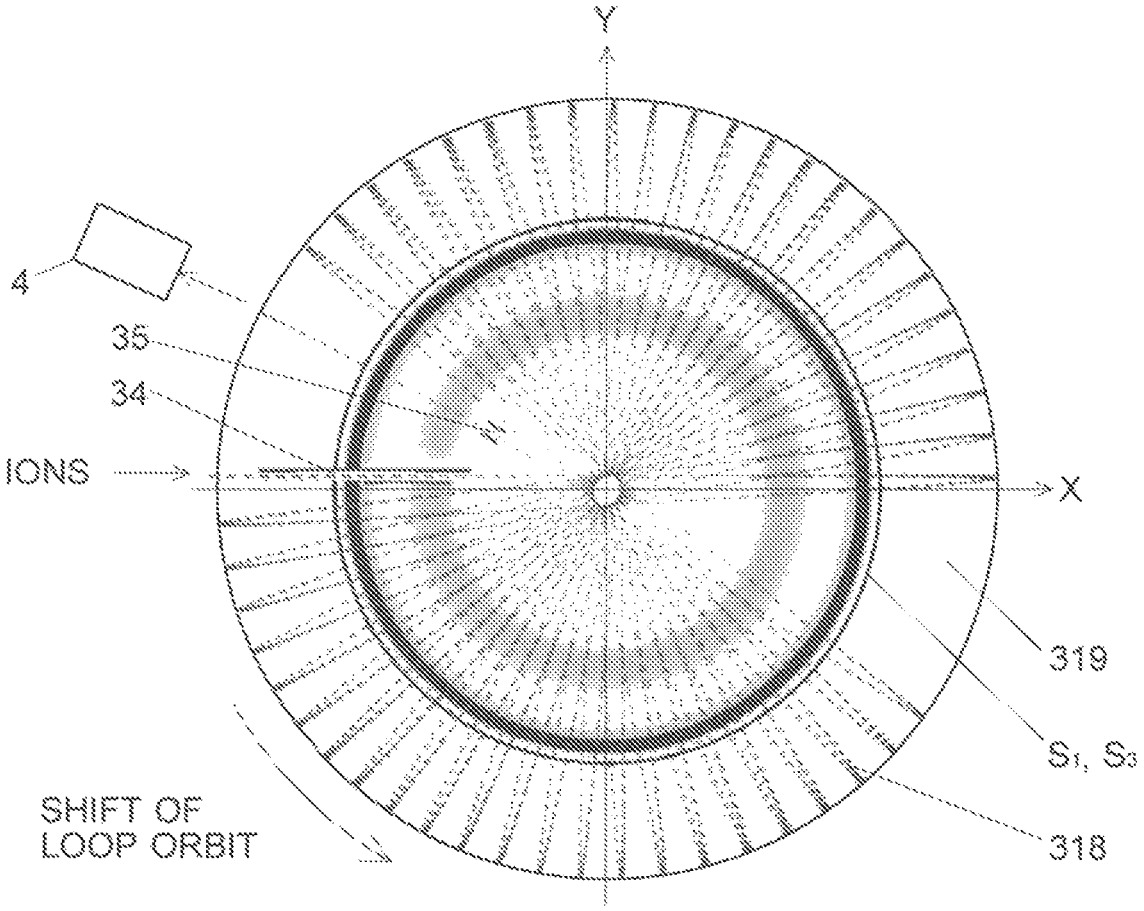
FIG. 3 is a top view showing the trajectory of an ion in the multi-turn mass-separating section shown in FIG. 2.

FIG. 1 is a schematic configuration diagram of a multi-turn TOFMS (hereinafter abbreviated as "MT-TOFMS") according to the present embodiment. FIGS. 2A and 2B are a vertical sectional view and top view, respectively, of a multi-turn mass-separating section in the MT-TOFMS according to the present embodiment. FIG. 3 is a top view showing the trajectory of an ion in the multi-turn mass-separating section shown in FIGS. 2A and 2B.

The MT-TOFMS according to the present embodiment includes an ion source 1, ion trap 2, TOF unit 3, ion-detecting unit 4, voltage-generating unit 5, control unit 6, gas supply unit 7, flow-regulating unit 8 and input unit 9. Though not shown, the ion trap 2, TOF unit 3 and ion-detecting unit 4 are contained in a chamber evacuated with a vacuum pump. The ion source 1 may be contained either in an evacuated chamber, or in an ionization chamber maintained at substantially atmospheric pressure, depending on the kind of ionization method.

The ion trap 2 is a linear ion trap, which includes four main electrodes 21, 22, 23 and 24 arranged in a rotationally symmetrical form around a straight ion beam axis 20, as well as end-cap electrodes 25 and 26 arranged at both ends of the main electrodes 21-24, sandwiching the main electrodes in between. Similar to the main electrodes 21-24, each of the end-cap electrodes 25 and 26 is also formed by four electrodes arranged in a rotationally symmetrical form around the ion beam axis 20. In other words, the main rod electrodes 21-24 and the end-cap electrodes 25 and 26 are formed by dividing four rod electrodes extending parallel to the ion beam axis 20 into segments arranged along the axis.

The TOF unit 3 includes a main electrode 31 having a spheroidal outer electrode 311 and a substantially spheroidal inner electrode 312 located inside the outer electrode 311. FIG. 2A is an end view (vertical sectional end view) of the main electrode 31 at the Z-X plane, which is a plane containing both the Z-axis that is the rotational axis in the substantially spheroidal body of the outer and inner electrodes 311 and 312, and the X-axis which is an axis orthogonal to the Z-axis. Cutting the main electrode 31 at any sectional plane containing the Z-axis always reveals substantially the same shape as shown in FIG. 2A, regardless of the angle of orientation of the section (i.e., the angular position around the Z axis). FIG. 2B is a top view of the main electrode 31 as viewed from the positive side in the Z-axis direction. An axis orthogonal to both the Z-axis and X-axis is the Y-axis. A plane containing both the X-axis and Y-axis is the X-Y plane.

The outer and inner electrodes 311 and 312 are formed by three partial-electrode pairs $S_1$, $S_2$ and $S_3$ each of which consists of a pair of electrodes having a curved shape in the Z-X plane and facing each other, combined with four partial-electrode pairs $L_1$, $L_2$, $L_3$ and $L_4$ each of which consists of a pair of electrodes having a linear shape in the Z-X plane and facing each other. The partial-electrode pair $S_2$ as viewed in the Z-X plane is located at both ends of the main electrode 21 in the X-axis direction and has a symmetrical shape with respect to the X-axis. The partial-electrode pair $S_1$ is located on the positive side of the Z-axis direction as viewed from the partial-electrode pair $S_2$. The partial-electrode pair $S_3$ is located on the negative side of the Z-axis direction as viewed from the partial-electrode pair $S_2$ and is symmetrical to the partial-electrode pair $S_1$ with respect to the X-axis. The partial-electrode pair $L_2$ is located between the partial-electrode pairs $S_1$ and $S_2$. The partial-electrode pair $L_3$ is located between the partial-electrode pairs $S_2$ and $S_3$, having a symmetrical shape to the partial-electrode pair $L_2$ with respect to the X-axis. The partial-electrode pair $L_1$ is shaped like a doughnut plate perpendicular to the Z-axis and is located on the positive side of the Z-axis direction as well as inside the partial-electrode pair $S_1$ when projected onto the X-Y plane. The partial-electrode pair $L_4$ is located on the negative side of the Z-axis direction and is symmetrical to the partial-electrode pair $L_1$ with respect to the X-axis.

By the combination of those partial-electrode pairs, each of the outer and inner electrodes 311 and 312 in its entirety shows a substantially spheroidal shape. For example, the outer electrode 311 has an external shape measuring 500 mm in the major-axis direction (X-axis and Y-axis directions) and 300 mm in the minor-axis direction (Z-axis direction). The distance between the outer and inner electrodes 311 and 312 is, for example, 20 mm. Reducing the entire size of the outer and inner electrodes 311 and 312 allows for the downsizing of the entire MT-TOFMS. Needless to say, those sizes are mere examples and are not limited to those values.

The partial-electrode pairs $S_1$, $S_2$ and $S_3$ which are curved in the Z-X plane are supplied with voltages from the voltage-generating unit 5 so that an electric field directed from the outer electrode 311 to the inner electrode 312 is created. On the other hand, the partial-electrode pairs $L_1$, $L_2$, $L_3$ and $L_4$ which are linear in the Z-X plane are supplied with voltages from the voltage-generating unit 5 so that the outer and inner electrodes 311 and 312 have the same potential. Thus, a loop-flight electric field which makes ions fly in a loop orbit within the space between the outer and inner electrodes 311 and 312 is created within this space. This space is hereinafter called the "loop-flight space" 319.

The outer electrode 311 in the partial-electrode pair $S_1$ is provided with an ion inlet 34 for introducing ions ejected from the ion trap 2 into the loop-flight space 319. The ion inlet 34 is located at a position slightly displaced from the X-Y plane toward the positive side of the Y-axis direction, and is arranged so that the ions from the ion trap 2 are injected substantially parallel to the X-axis. The ions undergo a centripetal force from the loop-flight electric field created by the partial-electrode pair $S_1$ at a position immediately after the point of injection from the ion inlet 34 into the loop-flight space 319. Additionally, due to the aforementioned displacement of the ion inlet 34 from the X-Y plane toward the positive side of the Y-direction, the ions also undergo a force directed toward the X-Y plane. Consequently, the ions follow a trajectory 318 (see FIG. 3) in which the ions fly along a substantially elliptical loop orbit multiple times within the loop-flight space 319, with the loop orbit gradually changing its orientation counterclockwise as viewed from the positive side of the Y-axis direction for each turn of the ions. In FIG. 3, the trajectory 318 of the ions is shown by a projection onto the X-Y plane.

The outer electrode 311 in the partial-electrode pair $S_3$ is provided with an ion outlet 35 for extracting ions from the loop-flight space 319 after the ions have made the loop flight a plurality of times (tens of times) within the loop-flight space 319. The ions extracted from the ion outlet 35 fly in a straight path. The ion-detecting unit 4 is located on this straight path.

According to the previously described configuration, ions having various mass-to-charge ratios ejected from the ion trap 2 fly in the loop-flight space 319 within the main electrode 31. During this flight, the ions are spatially separated from each other according to their mass-to-charge ratios and arrive at the ion-detecting unit 4 with temporal differences. In this TOF unit 3, the flight distance is the same for all ions since the trajectory 318 of the ions is determined independently of the mass-to-charge ratios of the ions. As shown in FIG. 3, the loop orbit of the ions gradually changes its orientation for each turn, so that the problem of the passing of the ions can be avoided, which will occur if the ions are made to repeatedly fly in the same loop orbit.

One example of a typical measurement operation in the MT-TOFMS according to the present embodiment is hereinafter described.

The ion source 1 ionizes a compound contained in an introduced sample. The generated ions are introduced through an ion injection opening 251 into the inner space of the ion trap 2. Meanwhile, under the control of the control unit 6, the voltage-generating unit 5 applies predetermined radio-frequency voltages to the four main electrodes 21-24, respectively, as well as predetermined direct voltages to the end-cap electrodes 25 and 26, respectively. Due to the thereby created electric field, the ions are captured within the inner space of the ion trap 2. The flow-regulating unit 8 receives a cooling gas (e.g., helium) from the gas supply unit 7 and supplies the gas to the ion trap 2 at a predetermined flow rate. The ions introduced into the inner space of the ion trap 2 come in contact with the cooling gas, whereby the kinetic energy of the ions is lowered. This makes the ions easier to be captured by the radio-frequency electric field and converged into an area near the ion beam axis 20.

After the ions have been sufficiently converged into an area near the ion beam axis 20 by the cooling process performed for a predetermined period of time, predetermined ejection voltages are applied from the voltage-generating unit 5 to the main electrodes 21-24. An amount of kinetic energy is thereby imparted to the ions in an orthogonal direction to the ion beam axis 20, or accelerated in this direction, and is simultaneously ejected from the ion trap 2 through an ejection port 211 formed in the main electrode 21. The ejected ions follow the ion introduction path and are introduced through the ion inlet 34 into the loop-flight space 319 in the TOF unit 3.

Ions which have completed the loop flight in the loop-flight space 319 in the previously described manner are extracted from the loop-flight space 319 through the ion outlet 35 and enter the ion-detecting unit 4. When ejected from the ion trap 2, each ion has a specific speed depending on its mass-to-charge ratio. Therefore, while flying in the loop-flight space 319, ion species having different mass-to-charge ratios are separated from each other and enter the ion-detecting unit 4 with temporal differences. The ion-detecting unit 4 produces a detection signal corresponding to the amount of ions it has received. Though not shown in FIG. 1, the detection signal produced by the ion-detecting unit 4 is sent to a data-processing unit, which converts the time of flight, as measured from the point in time of the ejection of the ions, into the mass-to-charge ratio and creates a mass spectrum showing the relationship between the mass-to-charge ratio and ion intensity.

Another mass separator, such as a quadrupole mass filter, and a collision cell configured to fragment ions by collision induced dissociation (CID) or similar techniques may be provided between the ion source 1 and the ion trap 2, in which case the product ions produced by fragmenting a precursor ion having a specific mass-to-charge ratio can be introduced into the ion trap 2 and subjected to mass spectrometry in the previously described manner. As another possibility, after ions have been captured within the inner space of the ion trap 2, a specific precursor ion may be selected by using the mass-separating capability of the ion trap 2, and the product ions produced by fragmenting the precursor ion by CID or the like may be subjected to mass spectrometry. By these configurations, an MS/MS analysis or $MS^n$ analysis can be performed.

The orbital shape in the TOF unit 3, as well as the configuration and structure of the electrodes forming the orbit, are not limited to those shown in FIGS. 1, 2A and 2B. Various kinds of commonly known designs can be used for those elements.

Figure 6A:
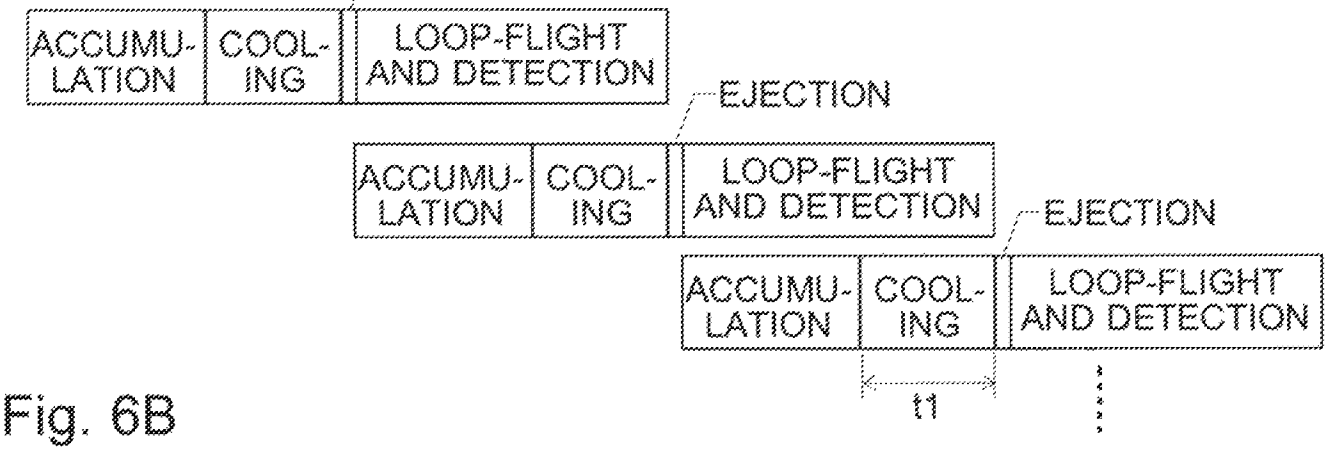
FIGS. 6A and 6B are charts each of which shows a measurement sequence in a repetitive measurement.
Figure 6B:
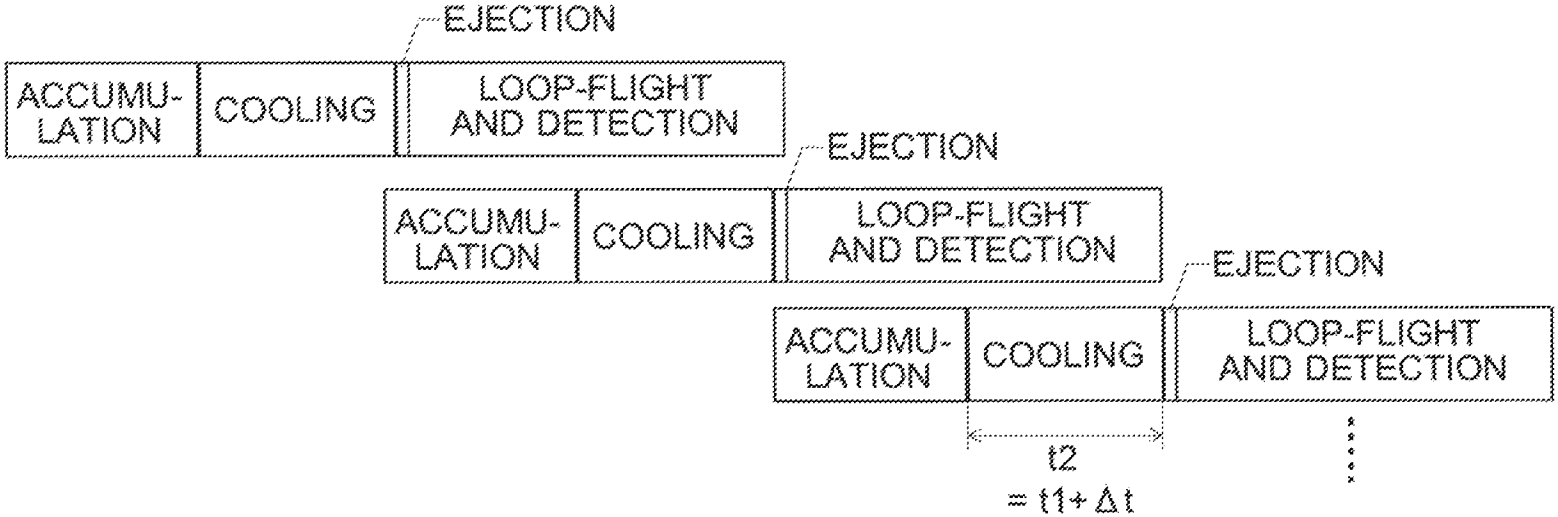

If a liquid chromatograph (LC) is connected to the entrance end of the MT-TOFMS shown in FIG. 1 so that a sample containing various compounds separated from each other with a column in the liquid chromatograph is introduced into the ion source 1 and subjected to a mass spectrometric analysis, or if a mass spectrometric analysis is performed on a sample introduced by the method of flow injection analysis without using a column, it is necessary to repeatedly perform a measurement for the sample continuously introduced into the ion source 1 in the MT-TOFMS. FIGS. 6A and 6B show measurement sequences in those cases.

In FIG. 6A, ions are introduced into the ion trap 2 in the"accumulation" period, which is followed by a "cooling" period in which the ions that have been introduced until immediately before this period are cooled. The cooled ions are subsequently ejected from the ion trap 2 in the extremely short "ejection" period. Those ions are made to fly in the loop-flight space 319 in the TOF unit 3 and be detected in the "loop-flight and detection" period. While the ions introduced into the ion trap 2 are being cooled, a further introduction of ions is prohibited. After the cooled ions have been ejected from the ion trap 2, the introduction and accumulation of the next ions to be analyzed are immediately initiated. In the example of FIG. 6A, the "cooling" period in the ion trap 2 is t1.

In the MT-TOFMS according to the present embodiment, the control unit 6 controls the operation of the flow-regulating unit 8 so as to appropriately regulate the flow rate of the cooling gas supplied to the ion trap 2, based on an instruction entered from the input unit 9 by the user, or based on an automatic determination according to an embedded program.

For example, when the user has prior information of the molecular weight of the compound to be analyzed or the number of charges of an ion to be analyzed, or when those pieces of information can be estimated by a certain method (as will be described later), the user enters the information of the molecular weight or number of charges from the input unit 9. Using the entered information of the molecular weight and the number of charges, or information of only the number of charges, the control unit 6 determines whether or not the collision cross section of the ion estimated from those pieces of information is equal to or larger than a predetermined threshold. If the collision cross section of the ion is equal to or larger than that threshold, the control unit 6 selects a "high-sensitivity mode", and if it is not the case, the unit 6 selects a "high-resolution mode". In the high-sensitivity mode, the amount of supply of the cooling gas is set at a lower level than in the high-resolution mode. In other words, if the ion to be analyzed has a high number of charges and large collision cross section, the amount of supply of the cooling gas is reduced in order to decrease the amount of gas which flows into the TOF unit 3. As described earlier, this operation makes the ions ejected from the ion trap 2 less likely to come in contact with the residual gas while flying in the ion introduction path or flight space. Consequently, the loss of the ions is reduced, and the detection sensitivity is improved.

The present device may additionally be configured to allow the user to perform an operation using the input unit 9 to select either the high-sensitivity mode which is suitable for an analysis of ions having high-molecular weights and high numbers of charges, or the high-resolution mode which is suitable for other normal types of compound ions. Needless to say, the mode names are not limited to the aforementioned ones. What is necessary is to allow the user to select one of the plurality of modes having different amounts of supply of the cooling gas.

If there is no prior information of the molecular weight of the compound to be analyzed or the number of charges of an ion to be analyzed, a preliminary measurement using the present device, or another mass spectrometer, is performed to obtain a mass spectrum in which a peak of the ion to be analyzed is observed. In the case of compounds which are mainly derived from living organisms as shown in FIG. 5, not only the monoisotopic peak but also a plurality of isotope peaks will be observed. The intervals between the monoisotopic peak and isotope peaks, or those between the isotope peaks, depend on the number of charges of the ion. Accordingly, it is possible to roughly estimate the number of charges of the ion from the peak intervals in one group of isotope peaks. Furthermore, the molecular weight can be roughly estimated from the mass-to-charge ratio of the monoisotopic peak and the number of charges of the ion.

Instead of regulating the amount of supply of the cooling gas based on an instruction or setting by the user, the device may, for example, initially perform the previously described preliminary measurement to estimate the molecular weight and number of charges of the compound to be analyzed, and subsequently perform the main measurement in which the amount of supply of the cooling gas is regulated based on the result of the preliminary measurement. As another example, the device may perform a measurement for the same compound two times with the amount of supply of the cooling gas set at two different levels. In that case, two mass spectra are obtained for the same compound. Those two mass spectra may be individually displayed (or outputted), or they may be merged into a single mass spectrum. The merging may be performed for each peak in such a manner that one of the corresponding peaks on the two mass spectra is selected according to a predetermined criterion.

Even when the amount of supply of the cooling gas is reduced for a high number of charges of the ion, the cooling effect can be sufficiently obtained within the ion trap 2 since the collision cross section of the ion is relatively large. In order to obtain the cooling effect more assuredly, the cooling time with a small amount of supply of the cooling gas may be elongated as compared to the case with a large amount of supply.

In normal cases, an ion having a high number of charges exceeding a range of 20-30 has a noticeably larger molecular weight than an ion having a low number of charges that is approximately 20 or lower. Therefore, despite its high number of charges, the former type of ion has a comparatively large mass-to-charge ratio. An ion having such a large molecular weight and high number of charges flies at a low speed and requires a long period of time to fly the same flight distance. Accordingly, in a repetitive measurement for this type of ion, it is necessary to set a longer "loop-flight and detection" period, as shown in FIG. 6B, than in a measurement for an ion having a small molecular weight and low number of charges. The "loop-flight and detection" period elongated in this manner allows for a corresponding elongation of the cooling time (in the example of FIGS. 6A and 6B, from t1 to t2=t1+Δt).

As described to this point, in the MT-TOFMS according to the present embodiment, when the collision cross section of the ion to be analyzed is large, the amount of supply of the cooling gas is relatively decreased to reduce the amount of gas flowing into the TOF unit 3 while ensuring the required cooling effect. The chamber which contains the TOF unit 3 is thereby maintained at high vacuum, and the loss of the ions due to the collision with the residual gas is reduced, without requiring a vacuum pump to have an unnecessarily high level of power for evacuating the chamber. This allows for the cost reduction of the vacuum pump as well as the use of a smaller and lighter vacuum pump.

In the MT-TOFMS according to the previously described embodiment, the cooling gas is directly introduced into the inner space of the ion trap 2. As another example, the device may be configured so that the cooling gas is introduced into a space which is outside the ion trap and yet inside the chamber which contains the ion trap 2 or a cell which surrounds the ion trap 2. It is naturally possible to configure the device so that the cooling gas is introduced into both the inside of the ion trap and a space outside the ion trap, with the amount of supply regulatable in one or both of those spaces.

The previously described technique of regulating the amount of supply of the cooling gas to maximally reduce the leakage of the cooling gas from the ion trap 2 or similar cooling unit into the TOF unit 3 (or the like) does not always need to be solely used; it will be useful to combine this technique with other measures so as to further improve the degree of vacuum within the chamber which contains the TOF unit 3 (or any other type of time-of-flight mass separator).

Specific examples of the measures that can be additionally used are as follows:

(1) The number of turbomolecular pumps for evacuating the chamber which contains the TOF unit 3 is increased. In the case of evacuating the chamber with a plurality of turbomolecular pumps, those pumps should be arranged so as to remove gas from areas on the outside of the electrodes having a relatively large surface area among the main electrodes 31 forming the loop-flight space 319 in the TOF unit 3 (in the example of FIG. 1, the areas above and below the loop-flight space), because gas can be easily released from the surfaces of the main electrodes 31 since the electrodes are made of metal. By this configuration, the degree of vacuum in the chamber can be improved, so that the loss of ions can be even further decreased.

(2) The ion trap 2 or ion-accelerating unit 2B which ejects ions, the ion optical system for converging the ejected ions, and the TOF unit 3 are individually contained in separate chambers. The ion-passing sections between the neighboring chambers are designed to have a low conductance, and each chamber is evacuated with an individual vacuum pump. Such a multi-stage differential pumping system makes the cooling gas used in the ion trap or ion-cooling unit less likely to leak into the ion optical system or TOF unit 3 in the subsequent stages. Consequently, the degree of vacuum in the chamber is improved, so that the loss of ions is even further decreased.

(3) Not only the electrodes included in the TOF unit 3, but any of the various members contained in the chamber as well as the members forming the chamber itself are also possible gas-releasing sources. Particularly noteworthy gas-releasing sources are components that give off heat when energized, such as the resistor elements (or other electronic parts) and cables provided for supplying power to each electrode in the TOF unit 3. Accordingly, it is preferable to bake those electronic parts, wiring parts, electrodes, insulators and other related components beforehand using a baking furnace (or the like) in the production process of the device so that the amount of gas which will be released from those parts will be decreased. The baking process may be performed on the aforementioned units after those units have been entirely assembled, rather than before the assembly. Another possible measure is to perform an electropolishing, chemical polishing or nickel-plating process on the surfaces of the electrodes or inner surface of the chamber to directly reduce the amount of gas that will be released.

In the case of performing the baking process after the assembly, the gas released from the electrodes, insulators and other components need to be smoothly removed to the outside to prevent their re-adsorption. To this end, for example, it is preferable to provide gas-removing openings at appropriate positions in the main electrodes so that the gas released from the inside of the main electrodes can be smoothly and promptly discharged. Those openings should preferably have a mesh structure so as to avoid unfavorable effects on the electric field created for making ions fly. In the case where an opening covering a particularly large area is formed in an electrode, the opening portion should preferably have a double mesh structure to reduce the disturbance of the electric field.

While being subjected to the baking process, the electrodes forming the TOF unit 3 are thermally expanded. When a plurality of positioning pins are provided for preventing the electrodes or insulators from being damaged or deformed, only one positioning pin may be configured to have a completely fixed position, while the other pins are configured to be slidable along an elongated hole to absorb the shift in their positions due to the thermal expansion. The size of the elongated hole can be determined based on the coefficient of thermal expansion of the material used for the components concerned (e.g., electrodes) and the temperature of the baking process to be performed.

As noted earlier, the MT-TOFMS according to the previously described embodiment has the same flight distance for all ions. The chance of an ion's colliding with the residual gas increases with the flight distance of the ion. Considering this factor, an auxiliary detector capable of detecting ions may be provided in the middle of the loop orbit or in the middle of the ion introduction path through which ions enter the loop orbit so that a mode for detecting ions with this auxiliary detector can be selected for ions that require a high level of sensitivity. This configuration allows the flight distance of the ions to be shortened so as to lower the probability of the collision with the residual gas and reduce the loss of the ions. For ions for which mass-resolving power is more important than sensitivity, the long, original flight distance can be used to detect the ions with the main ion-detecting unit.

After the relevant members have been baked in the process of producing the device in the previously described manner, gas molecules and moisture may possibly be adsorbed to the surfaces of those members if they are exposed to the air during the assembly of the device. To address this problem, the assembly of the device, and particularly, that of the TOF unit 3 may preferably be performed within a substantially sealed space which is separated from the outer areas by a plastic sheet or similar material and is continuously supplied with nitrogen, dry air or similar gas. This method reduces the amount of adsorption of the gas and moisture to the surfaces of the members of the device, thereby suppressing the generation of unnecessary residual gas. This type of measure can also shorten the period of time to achieve a predetermined degree of vacuum when the device is used.

In the process of restoring the inner state of the chamber from the vacuum state to the atmospheric state after the use of the device, it is preferable to introduce a pure gas with a moisture content in the order of ppm into the chamber and fill the same chamber with the pure gas, instead of introducing normal air into the chamber. This prevents the re-attachment of moisture onto the members arranged within the chamber. The leak valve for introducing the pure gas into the chamber may preferably be equipped with a dehumidifying tube to further lower the moisture content of the pure gas and more effectively prevent the adsorption of the moisture. By this measure, the degree of vacuum can be rapidly increased to a desired level the next time the evacuation is performed, and the amount of residual gas which causes the loss of ions can also be further decreased.

The previously described embodiment is concerned with the case of applying the present invention in an MT-TOFMS. It is evident that the present invention is also applicable in a linear, reflectron or multi-reflectron TOFMS. However, it should be noted that the longer the flight distance, the more serious the influence of the loss of ions due to their collision with the residual gas. In the case of a device having a comparatively short flight distance, such as a linear TOFMS, reducing the amount of cooling gas may result in a situation in which the undesirable effect of the deterioration in mass accuracy or mass-resolving power due to the decreased amount of cooling gas is more noticeable than the effect of the improvement in detection sensitivity.

The previously described embodiment and its variations are mere examples of the present invention. It is evident that any modification, change or addition appropriately made within the spirit of the present invention will also fall within the scope of claims of the present application.

[Various Modes]

A person skilled in the art can understand that the previously described illustrative embodiment is a specific example of the following modes of the present invention.

(Clause 1) One mode of the method for mass spectrometry according to the present invention is a method for mass spectrometry in which ions to be analyzed are made to come in contact with a cooling gas in a cooling section configured to perform the cooling of ions, and kinetic energy is subsequently imparted to the ions so as to introduce the ions into a flight space for separating ions according to the mass-to-charge ratios of the ions, where the method is configured so that, when a known or estimated number of charges of an ion to be analyzed is high, the amount of supply of the cooling gas to the cooling section is set to a lower level than when the number of charges is low.

Reducing the amount of supply of the cooling gas to the cooling section results in a corresponding reduction in the amount of gas which flows from the cooling section into the subsequent flight space, ion introduction path which guides the ions to the flight space, and other related areas. Therefore, by the method for mass spectrometry described in Clause 1, it is possible to reduce the loss of an ion which has such a large molecular weight and high number of charges that give the ion a particularly large collision cross section which makes the ion easy to collide with a residual gas and be lost. Consequently, the detection sensitivity for ions having large molecular weights and high numbers of charges will be improved.

(Clause 5) One mode of the mass spectrometer according to the present invention is a mass spectrometer for carrying out the method for mass spectrometry described in Clause 1, the mass spectrometer including:

a cooling section configured to perform the cooling of ions to be analyzed, by making the ions come in contact with a cooling gas;

an ion-accelerating section configured to impart kinetic energy to the ions after the cooling;

a time-of-flight mass-separating section including a flight space for separating ions according to the mass-to-charge ratios of the ions, the flight space configured so that the ions having the kinetic energy imparted in the ion-accelerating section are introduced into the flight space;

a detecting section configured to detect the ions separated by the time-of-flight mass-separating section; and a gas-supply regulating section configured to regulate the amount of supply of the cooling gas to the cooling section so that the amount of supply is changed according to a known or estimated number of charges of an ion to be analyzed.

The mass spectrometer described in Clause 5 can relatively decrease the amount of supply of the cooling gas when analyzing an ion having a large molecular weight and high number of charges. This reduces the loss of ions and improves the detection sensitivity for an ion which has such a large molecular weight and high number of charges that give the ion a particularly large collision cross section which makes the ion easy to collide with a residual gas and be lost.

(Clause 2) In the method for mass spectrometry described in Clause 1, the cooling section may be an ion trap configured to capture and accumulate ions, and the method may include ejecting the ions by imparting kinetic energy to the ions after cooling the ions within the ion trap.

The ion trap may be an ion trap configured to capture ions by the effect of an electric field. For example, it may be configured as a three-dimensional quadrupole or linear ion trap.

According to the method for mass spectrometry described in Clause 2, a high level of cooling effect can be obtained since the cooling of ions is performed by making the cooling gas come in contact with the ions confined in the inner space of the ion trap. A regulation of the cooling effect, such as the operation of elongating of the cooling time when the amount of supply of the cooling gas is decreased, can also be easily performed.

(Clause 3) In the method for mass spectrometry described in Clause 1 or 2, the flight space may be a flight space of a multi-turn time-of-flight mass separator.

In the multi-turn system, since the ions are made to fly a long distance, they tend to frequently come in contact with the residual gas, and the influence of the loss of the ions due to the contact with the residual gas is significant. The method for mass spectrometry described in Clause 3 can decrease the amount of cooling gas flowing into the flight space of a multi-turn time-of-flight mass separator, whereby the loss of ions can be reduced and a sufficient effect of the improvement in detection sensitivity can be achieved.

(Clause 4) The method for mass spectrometry described in Clause 3 may be configured to allow for the execution of a mode in which ions are detected with a detector located in the middle of a loop orbit in which ions fly in the flight space or in the middle of an ion introduction path through which ions enter the loop orbit.

According to the method for mass spectrometry described in Clause 4, even in the case where a multi-turn time-of-flight mass separator is used, the flight distance of the ions to be analyzed can be shortened as needed. This lowers the probability of the collision of the ions with the residual gas and reduces the loss of the ions, whereby the sensitivity of the analysis can be improved. When mass-resolving power is considered to be more important than analysis sensitivity, the detection of ions in the middle of the path can be disabled so as to detect the ions with the main detector after making the ions fly a sufficiently long distance.

REFERENCE SIGNS LIST

1 . . . Ion Source
2 . . . Ion Trap
20 . . . Ion Beam Axis
21-24 . . . Main Electrode
211 . . . Ejection Port
25, 26 . . . End-Cap Electrode
251 . . . Ion Injection Opening
2A . . . Ion-Cooling Unit
2B . . . Ion-Accelerating Unit
3 . . . TOF Unit
31 . . . Main Electrode
311 . . . Outer Electrode
312 . . . Inner Electrode
318 . . . Orbital Path
319 . . . Loop-Flight Space
34 . . . Ion Inlet
35 . . . Ion Outlet
4 . . . Ion-Detecting Unit
5 . . . Voltage-Generating Unit
6 . . . Control Unit
7 . . . Gas Supply Unit
8 . . . Flow-Regulating Unit
9 . . . Input Unit

The invention claimed is:

1. A method for mass spectrometry, comprising:

contacting ions to be analyzed with a cooling gas in a cooling section configured to perform cooling of ions, subsequently imparting kinetic energy to the ions so as to introduce the ions into a flight space for separating ions according to mass-to-charge ratios of the ions, and regulating an amount of supply of the cooling gas to the cooling section so that the amount of supply is changed according to a known or estimated number of charges of an ion to be analyzed.

2. The method for mass spectrometry according to claim 1, wherein the cooling section is an ion trap configured to capture and accumulate ions, and the method comprises ejecting the ions by imparting kinetic energy to the ions after cooling the ions within the ion trap.

3. The method for mass spectrometry according to claim 1, wherein the flight space is a flight space of a multi-turn time-of-flight mass separator.

4. The method for mass spectrometry according to claim 3, wherein the method is configured to allow for execution of a mode in which ions are detected with a detector located in a middle of a loop orbit in which ions fly in the flight space or in a middle of an ion introduction path through which ions enter the loop orbit.

5. A mass spectrometer comprising:

a cooling section configured to perform cooling of ions to be analyzed, by making the ions come in contact with a cooling gas;

an ion-accelerating section configured to impart kinetic energy to the ions after the cooling;

a time-of-flight mass-separating section including a flight space for separating ions according to mass-to-charge ratios of the ions, the flight space configured so that the ions having kinetic energy imparted in the ion-accelerating section are introduced into the flight space;

a detecting section configured to detect the ions separated by the time-of-flight mass-separating section; and a gas-supply regulating section configured to regulate an amount of supply of the cooling gas to the cooling section so that the amount of supply is changed according to a known or estimated number of charges of an ion to be analyzed.

* * * * *